US008116647B2

(12) United States Patent
Fujihara et al.

(10) Patent No.: US 8,116,647 B2
(45) Date of Patent: Feb. 14, 2012

(54) IMAGE FORMING APPARATUS AND METHOD FOR CONTROLLING SAME

(75) Inventors: Kensuke Fujihara, Osaka (JP); Tamotsu Shimizu, Osaka (JP); Ryota Maeda, Osaka (JP); Kouji Fujii, Osaka (JP); Tomoyuki Kikuta, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 282 days.

(21) Appl. No.: 12/618,863

(22) Filed: Nov. 16, 2009

(65) Prior Publication Data

US 2010/0129102 A1 May 27, 2010

(30) Foreign Application Priority Data

Nov. 21, 2008 (JP) ..... 2008-298005

(51) Int. Cl.

| | |
|---|---|
| ***G03G 15/00*** | (2006.01) |
| ***G03G 15/06*** | (2006.01) |
| ***G03G 15/08*** | (2006.01) |
| ***G03G 15/10*** | (2006.01) |

(52) U.S. Cl. ..... 399/55; 399/26; 399/235; 399/240; 399/270; 399/285

(58) Field of Classification Search ..... 399/26, 399/55, 235, 240, 270, 285
See application file for complete search history.

(56) References Cited

U.S. PATENT DOCUMENTS

| | | | | |
|---|---|---|---|---|
| 2003/0175055 | A1 | 9/2003 | Machida et al. | |
| 2005/0158061 | A1 * | 7/2005 | Do | 399/44 |
| 2007/0134015 | A1 * | 6/2007 | Watanabe | 399/55 |
| 2007/0264034 | A1 * | 11/2007 | Kamoshida | 399/26 |

FOREIGN PATENT DOCUMENTS

| | | |
|---|---|---|
| JP | 3815356 | 6/2006 |

* cited by examiner

*Primary Examiner* — David Gray
*Assistant Examiner* — Joseph Wong
(74) *Attorney, Agent, or Firm* — Smith, Gambrell & Russell, LLP

(57) ABSTRACT

An image forming apparatus includes: a photoconductive drum; a developing roller carrying toner; a DC voltage application portion outputting a DC voltage to be applied to the developing roller, and receiving a feedback voltage; an AC voltage application portion applying an AC voltage to be applied to the developing roller; a detection portion detecting occurrence of electric discharge; a first resistor portion generating a feedback voltage that is fed to the DC voltage application portion; a second resistor portion connected between the DC voltage application portion and the AC voltage application portion, and having a switching portion with which conducting on and off are switchable; and a control portion controlling the switching portion, at the time of printing, to bring the second resistor portion into a conducting state and, at the time of electric discharge detection, to bring the second resistor portion into a non-conducting state.

20 Claims, 9 Drawing Sheets

IMAGE FORMING APPARATUS AND METHOD FOR CONTROLLING SAME

This application is based upon and claims the benefit of priority from the corresponding Japanese Patent Application No. 2008-298005 filed Nov. 21, 2008, the entire contents of which are incorporated herein by reference.

BACKGROUND OF THE INVENTION

1. Field of the Invention

The present invention relates to an image forming apparatuses such as a multi-function printer (MFP), copier, printer or facsimile machine, and to a method for controlling the same.

2. Description of Related Art

Conventionally, in some image forming apparatuses using toner, such as multi-function printers, copiers, printers, and facsimile machines, there are arranged a photoconductive drum and, opposite it with a gap in between, a developing roller. To the developing roller, a so-called developing bias is applied that has a direct current (DC) and an alternating current (AC) superimposed on each other. As a result, charged toner flies from the developing roller to the photoconductive drum, and thereby an electrostatic latent image is developed. The toner image thus developed is transferred onto and fixed to a sheet, and thereby printing is achieved.

Here, to feed sufficient toner to the photoconductive drum, to obtain desired density in the image formed, and to enhance development efficiency, the peak-to-peak voltage of the AC voltage applied to the developing roller may be increased; however, if it is increased too far, electric discharge occurs in the gap between the photoconductive drum and the developing roller. When electric discharge occurs, due to a potential change on the surface of the photoconductive drum, the static latent image is disturbed, and the quality of the image formed is deteriorated. The photoconductive drum can have a property such that, depending on the direction in which the discharge current flows, a large current may flow through the photoconductive drum. When a large current flows, the photoconductive drum may suffer damage, such as a minute hole (pinhole) developing in it. Accordingly, the peak-to-peak voltage may be increased, but within the range in which no electric discharge occurs.

Thus, there is conventionally known a developing unit provided with an image carrying member and, opposite it at a desired interval in the developing region, a toner carrying member, wherein a developing bias voltage having a DC voltage and an AC voltage superimposed on each other is applied between the toner carrying member and the image carrying member so that toner is fed to the image carrying member to develop an electrostatic latent image, there are provided a leak generating means for varying a leak detection voltage applied between the image carrying member and the toner carrying member and a leak detecting means for detecting leakage, wherein, as the maximum potential difference $\Delta V_{max}$ between the leak detecting voltage and the surface potential of the image carrying member is increased, when the current flowing between the image carrying member and the toner carrying member increases continuously, the leak detecting means recognizes leakage.

Here, as in a case where an electric discharge start voltage is searched, electric discharge to be detected may be minute. When electric discharge is minute, the greater a resistance value of a resistor that converts a current on occurrence of electric discharge into a voltage, the larger a range in which a voltage on occurrence of electric discharge varies. Accordingly, it is possible to detect electric discharge with increased sensitivity. As the resistance value of the resistor is increased, however, when, during printing, there is a change in the potential of the developing roller, such as a rise in the potential due to an external factor, there appears a large change in a feedback voltage fed to a direct-current (DC) application portion that applies a DC voltage to the developing roller. As a result, the DC voltage application portion stops outputting or reduces an output voltage, causing a problem that the output voltage of the DC voltage application portion becomes unstable. When the output voltage of the DC voltage application portion becomes unstable, there arises a problem that may affect the quality of images, such as an error in the density of the images to be formed.

Incidentally, some conventional developing apparatuses have, as a configuration for detecting leakage (electric discharge), a current detector detecting a current flowing on occurrence of electric discharge; a specific configuration of that current detector varies, and may not be one that performs no feedback of a direct current applied to the developing roller. Accordingly, with the conventional developing units, it is impossible to solve the above-described problems.

SUMMARY OF THE INVENTION

In view of the above-mentioned problems experienced with the conventional technology, an object of the present invention is to prevent, at the time of printing, instability of the output voltage of the DC voltage application portion caused by a large variation in the potential of the developing roller due to an external factor, and to detect electric discharge occurred, with increased sensitivity at the time of detection of electric discharge.

To achieve the above object, according to the invention, an image forming apparatus is provided with: a photoconductive drum; a developing roller opposite the photoconductive drum with a gap secured in between, and carrying toner that is fed to the photoconductive drum; a DC voltage application portion outputting a DC voltage applied to the developing roller, and receiving a feedback voltage to adjust the DC voltage to output or stop the outputting; an AC voltage application portion connected to the DC voltage application portion, and applying to the developing roller, a voltage having the DC voltage outputted from the DC voltage application portion and an AC voltage superimposed on each other; a detection portion detecting occurrence of electric discharge between the developing roller and the photoconductive drum based on a variation in the DC voltage applied to the developing roller; a first resistor portion generating from the DC voltage applied to the developing roller the feedback voltage that is fed to the DC voltage application portion; a second resistor portion connected between the DC voltage application portion and the AC voltage application portion, and having a switching portion switchable between on and off of conducting; and a control portion controlling the apparatus, recognizing whether or not electric discharge has occurred based on an output of the detection portion, and controlling the switching portion to bring the second resistor portion into a conducting state during printing, and into a non-conducting state during electric discharge detection in which while the AC voltage application is made to vary stepwise a peak-to-peak voltage of the AC voltage applied to the developing roller, a peak-to-peak voltage at which electric discharge start between the photoconductive drum and the developing roller is detected.

This makes it possible to make the DC voltage application portion operate in a stable manner during printing, and to detect occurrence of electric discharge with increased sensitivity during electric discharge detection.

Further features and advantages of the present invention will become apparent from the description of embodiments given below.

DETAILED DESCRIPTION OF PREFERRED EMBODIMENTS

An embodiment of the present invention will be described with reference to FIGS. 1 to 9. In this embodiment, the invention finds applications in image forming apparatuses, such as multi-function printers and copiers. In the following description, an electrophotographic, tandem-type color printer 1 (corresponding to an image forming apparatus) will be taken up as an example for description. It should be understood, however, that none of the features in respect of construction, arrangement, etc., that are given in connection with the embodiment is meant to limit the scope of the invention in any way, that is, those features are simply examples for the sake of description.

Outline Construction of Image Forming Apparatus

Figure 1:
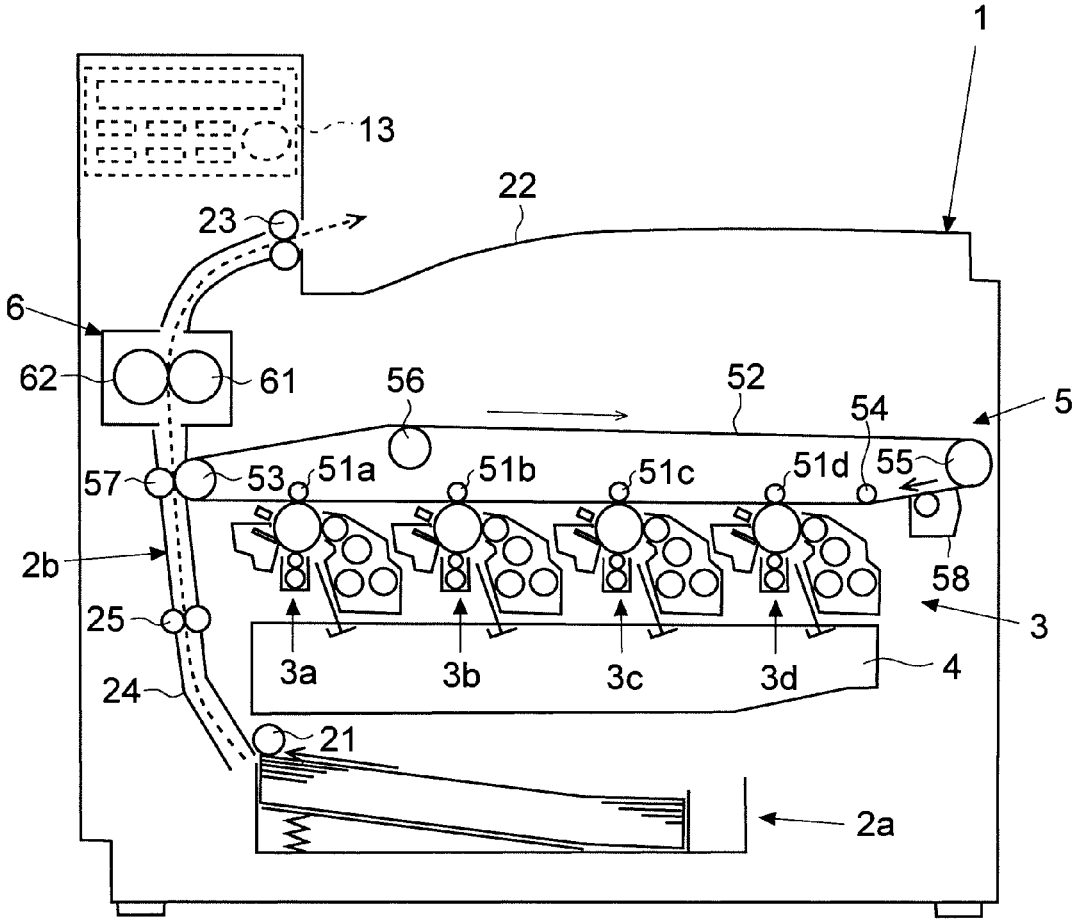
FIG. 1 is a sectional view showing an outline of the construction of a printer according to an embodiment of the present invention.
Figure 2:
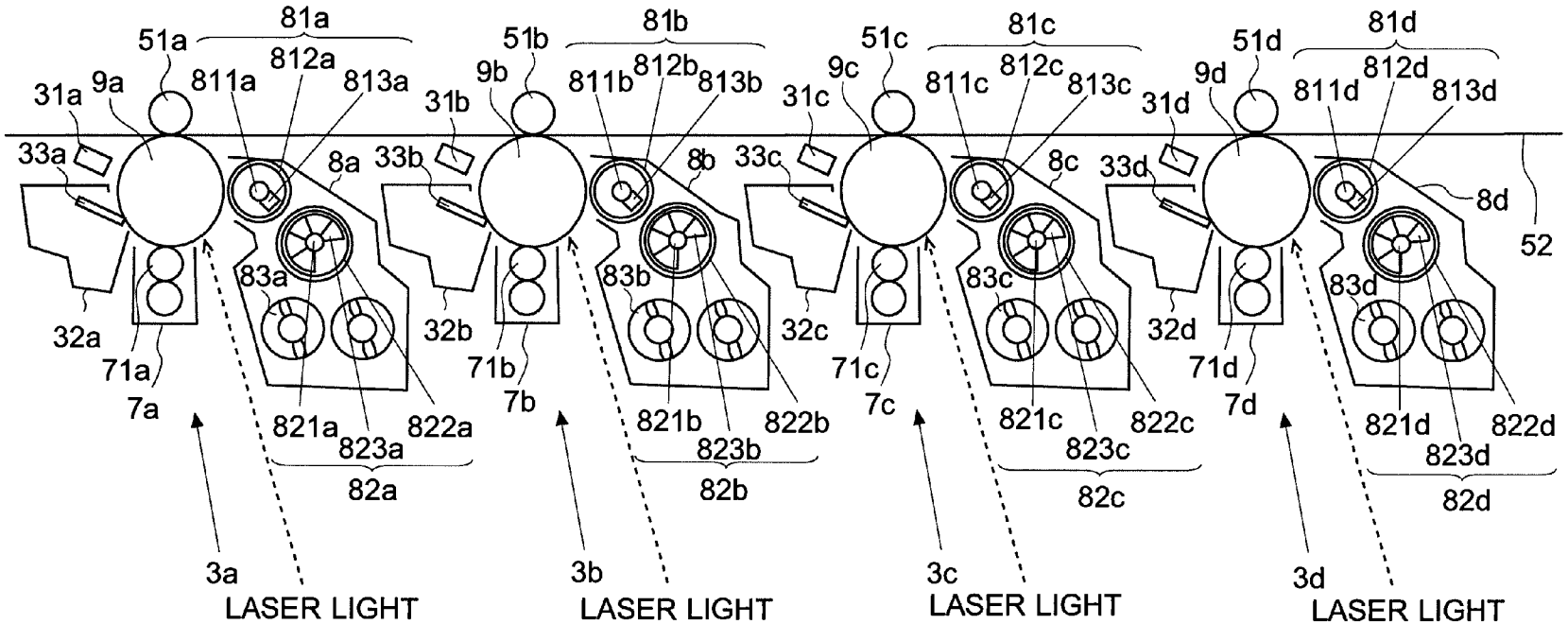
FIG. 2 is an enlarged sectional view of individual image formation portions according to the embodiment.

First, with reference to FIGS. 1 and 2, an outline of the printer 1 according to the embodiment will be described. FIG. 1 is a sectional view showing an outline of the construction of the printer 1 according to the embodiment of the invention. FIG. 2 is an enlarged sectional view of individual image formation portions 3 according to the embodiment of the invention. As shown in FIG. 1, the printer 1 according to the embodiment is provided with, inside a cabinet, a sheet feed portion 2*a*, a transport passage 2*b*, an image formation portion 3, an exposing unit 4, an intermediate transfer portion 5, a fixing unit 6, etc.

The sheet feed portion 2*a* accommodates sheets of different types, such as copying paper sheets, OHP (overhead projector) sheets, and label paper sheets, to name a few. The sheet feed portion 2*a* feeds the sheets out into the transport passage 2*b* by a paper feed roller 21 rotated by a drive mechanism (unillustrated) such as a motor. Through the transport passage 2*b*, the sheets are transported inside the printer 1. The transport passage 2*b* guides the sheets fed from the sheet feed portion 2*a* via the intermediate transfer portion 5 and the fixing unit 6 to an ejection tray 22. The transport passage 2*b* is provided with a pair of transfer rollers 23 and guides 24. The transport passage 2*b* is also provided with, among others, a pair of resist rollers 25*b* that keeps the sheets transported to it in a stand-by state in front of the intermediate transfer portion 5 before feeding them out with proper timing.

As shown in FIGS. 1 and 2, the printer 1 is provided with, as a part that forms a toner image based on image data of an image to be formed, image formation portions 3 for four colors. Specifically, the printer 1 is provided with an image formation portion 3*a* that forms a black image (including a charging unit 7*a*, a developing unit 8*a*, a charge eliminating unit 31*a*, a cleaning unit 32*a*, etc.), an image formation portion 3*b* that forms a yellow image (including a charging unit 7*b*, a developing unit 8*b*, a charge eliminating unit 31*b*, a cleaning unit 32*b*, etc.), an image formation portion 3*c* that forms a cyan image (including a charging unit 7*c*, a developing unit 8*c*, a charge eliminating unit 31*c*, a cleaning unit 32*c*, etc.), and an image formation portion 3*d* that forms a magenta image (including a charging unit 7*d*, a developing unit 8*d*, a charge eliminating unit 31*d*, a cleaning unit 32*d*, etc.).

Now, with reference to FIG. 2, the image formation portions 3*a* to 3*d* will be described in detail. The image formation portions 3*a* to 3*d* differ among themselves only in the color of the toner image they form, and have basically a similar construction. Accordingly, in the following description, the letters a, b, c, and d for distinguishing which of the image formation portions 3 to belong to will be omitted unless necessary (in FIG. 2, the components of one of the image formation portions 3*a*, 3*b*, 3*c*, and 3*d* are distinguished from those of the others by reference signs having one of the letters a, b, c, and d added to them).

Each photoconductive drum 9 is rotatably supported, and is driven, by receiving a drive force from a motor M (see FIG. 3), to rotate at a predetermined speed counter-clockwise as seen on the plane of the figure. Each photoconductive drum 9 carries a toner image on its peripheral surface. Each photoconductive drum 9 has a photoconductive layer or the like of amorphous silicon or the like on the outer peripheral surface of a drum, as a base member, formed of aluminum. In this embodiment, each photoconductive drum 9 is of a positive-charging type.

Each charging unit 7 has a charging roller 71, and charges the corresponding photoconductive drum 9 with a given electric charge. Each charging roller 71 makes contact with the corresponding photoconductive drum 9, and rotates together with it. To each charging roller 71, a charge voltage application portion 72 (see FIG. 3) applies a voltage having a direct current (DC) and an alternating current (AC) superimposed on each other. This causes the surface of the photoconductive drum 9 to be charged uniformly to a predetermined positive potential (e.g., 200 V to 300 V, the dark potential). The charging unit 7 may instead be of a corona-discharge type, or may be one that charges the photoconductive drum 9 by use of a brush or the like.

Each developing unit 8 accommodates a developer containing toner and a magnetic carrier (a so-called two-component developer). The developing unit 8*a* accommodates a black developer, the developing unit 8*b* accommodates a yellow developer, the developing unit 8*c* accommodates a cyan developer, and the developing unit 8*d* accommodates a magenta developer. Each developing unit 8 includes a developing roller 81, a magnetic roller 82, and a carrying member 83. Each developing unit 8 supports the developing roller 81 with a gap from, and opposite, the corresponding photoconductive drum 9, and feeds toner to the developing roller 81. Each developing roller 81 is arranged opposite, and with a predetermined gap (e.g., 1 mm or less) from, the photoconductive drum 9. The developing roller 81 carries toner to be charged at the time of printing (image formation). The developing roller 81 is connected to an AC voltage application portion 86 (see FIG. 3, the details will be given later) that outputs an AC voltage to feed the toner to the photoconductive drum 9.

Each magnetic roller 82 is located opposite the corresponding developing roller 81. Each magnetic roller 82 is connected to a magnetic roller bias application portion 84 (see FIG. 3). Under application of a voltage (magnetic roller bias), having a DC voltage and an AC voltage superimposed on each other, from the magnetic bias application portion 84, each magnetic roller 82 feeds toner to the developing roller 81. The magnetic roller 82 is arranged to the lower right of the developing roller 81, with a predetermined gap (e.g., 1 mm to several millimeters) from it. Each carrying member 83 is arranged below the corresponding magnetic roller 82.

Each developing roller 82 and each magnetic roller 82 have their respective roller shafts 811 and 821 fixedly supported by supporting members (unillustrated) or the like. The roller shafts 811 and 821 inside each developing roller 81 and each magnetic roller 82 are fitted with magnets 813 and 823, respectively, that extend in the axial direction. Each developing roller 81 and each magnetic roller 82 have cylindrical sleeves 812 and 822, respectively, that cover the magnets 813 and 823. At the time of printing and at the time of electric discharge detection, an unillustrated drive mechanism rotates these sleeves 812 and 822 (see FIG. 3). At positions on the developing roller 81 and the magnetic roller 82 opposite each other, the opposite poles of the magnet 813 of the developing roller 81 and the magnet 823 of the magnetic roller 82 face each other.

Thus, between each developing roller 81 and the corresponding magnetic roller 82, the magnetic carrier forms a magnetic brush. The magnetic brush, rotation of the sleeve 822 of the magnetic roller 82, application of a voltage to the magnetic roller 82 (the magnetic roller bias application portion 84), etc. cause toner to be fed to the developing roller 81. As a result, a thin layer of toner is formed on the developing roller 81. The toner that remains after development is attracted off the developing roller 81 by the magnetic brush. Each carrying member 83 has a screw formed in the shape of a spiral around the axis. Each carrying member 83 transports and agitates the developer inside the corresponding developing unit 8. As a result, friction between the toner and the carrier causes the toner to be charged (in this embodiment, the toner is charged positively).

Each cleaning unit 32 cleans the corresponding photoconductive drum 9. Each cleaning unit 32 has a blade 33 that extends in the axial direction of the photoconductive drum 9, and that is formed of, for example, resin, and a scraping roller 34 that scrapes the surface of the photoconductive drum 9 to remove residual toner. Each blade 33 makes contact with the photoconductive drum 9, and scrapes off and removes dirt such as residual toner after transfer. Above each cleaning unit 32, a charge eliminating unit 31 (e.g., arrayed LEDs) is provided that irradiates the photoconductive drum 9 with light to eliminate electric charge from it.

The exposing unit 4 below the image formation portions 3 is a laser unit that outputs laser light. The exposing unit 4 outputs the laser light (indicated by broken lines) in the form of optical signals based on color-separated image signals fed to it. The exposing unit 4 scans with and exposes to the laser light the charged photoconductive drums 9 to form an electrostatic latent image.

For example, the exposing unit 4 is provided with, inside it, a semiconductor laser device (laser diode), a polygon mirror, a polygon motor, an fθ lens, a mirror (unillustrated), etc. So constructed, the exposing unit 4 irradiates the photoconductive drums 9 with laser light. As a result, electrostatic latent images according to the image data are formed on the photoconductive drums 9. Specifically, in this embodiment, the photoconductive drums 9 are all charged positively. Accordingly, at their parts exposed to light, the potential falls (e.g., to about 0 V), and positively charged toner attached to the parts where the potential has fallen. For example, in the case of a solid filled image, all the lines and all the pixels are irradiated with laser light. As the exposing unit 4, for example, one composed of a large number of LEDs may be used.

In the exposing unit 4, a light-receiving element (unillustrated) is provided within the range irradiated with laser light but outside the range in which the photoconductive drum 9 is irradiated. When irradiated with laser light, the light-receiving element outputs an electric current (voltage). This output is fed to, for example, a CPU (central processing unit) 11, which will be described later. The CPU 11 uses this as a synchronizing signal at the time of detection of whether or not electric discharge is occurring (see FIG. 5).

The description will now continue with reference back to FIG. 1. The intermediate transfer portion 5 receives primary transfer of toner images from the photoconductive drums 9, and performs secondary transfer onto a sheet. The intermediate transfer portion 5 is composed of primary transfer roller 51*a* to 51*d*, an intermediate transfer belt 52, a driving roller 53, following rollers 54, 55, and 56, a secondary transfer roller 57, a belt cleaning unit 58, etc. The intermediate transfer belt 52, which is endless, is nipped between the primary transfer rollers 51*a* to 51*d* and the corresponding photoconductive drums 9. Each primary transfer roller 51 is connected to a transfer voltage application portion (unillustrated) that applies transfer voltage, and transfers a toner image onto the intermediate transfer belt 52.

The intermediate transfer belt 52 is formed of a dielectric resin or the like, and is wound around the driving roller 53, the following rollers 54, 55, and 56, and all the primary transfer rollers 51. As the driving roller 53, which is connected to a drive mechanism (unillustrated) such as a motor, is driven to rotate, the intermediate transfer belt 52 rotates clockwise as seen on the plane of the figure. The intermediate transfer belt 52 is nipped between the driving roller 53 and the secondary transfer roller 57, and thus a nip (secondary transfer portion) is formed.

To transfer the toner images, first, a predetermined voltage is applied to the primary transfer rollers 51. The toner images (black, yellow, cyan, and magenta respectively) formed in the image formation portions 3 are primary-transferred onto the intermediate transfer belt 52 such that one image is superimposed on the next with no deviation. The resulting toner image thus having the different colors superimposed on one another is then transferred onto a sheet by the secondary transfer roller 57 having a predetermined voltage applied to it. Residual toner and the like remaining on the intermediate transfer belt 52 after secondary transfer is removed and collected by the belt cleaning unit 58 (see FIG. 1).

The fixing unit 6 is disposed on the downstream side of the secondary transfer portion with respect to the sheet transport direction. The fixing unit 6 heats and presses the secondary-transferred toner image to fix it on the sheet. The fixing unit 6 is composed mainly of a fixing roller 61, which incorporates a heat source, and a pressing roller 62, which is pressed against the fixing roller 61. Between the fixing roller 61 and the pressing roller 62, a nip is formed. As the sheet having the toner image transferred onto it passes between the nip, it is heated and pressed. As a result, the toner image is fixed to the sheet. The sheet after fixing is ejected into the ejection tray 22, and this completes image formation processing.

Hardware Configuration of Printer 1

Figure 3:
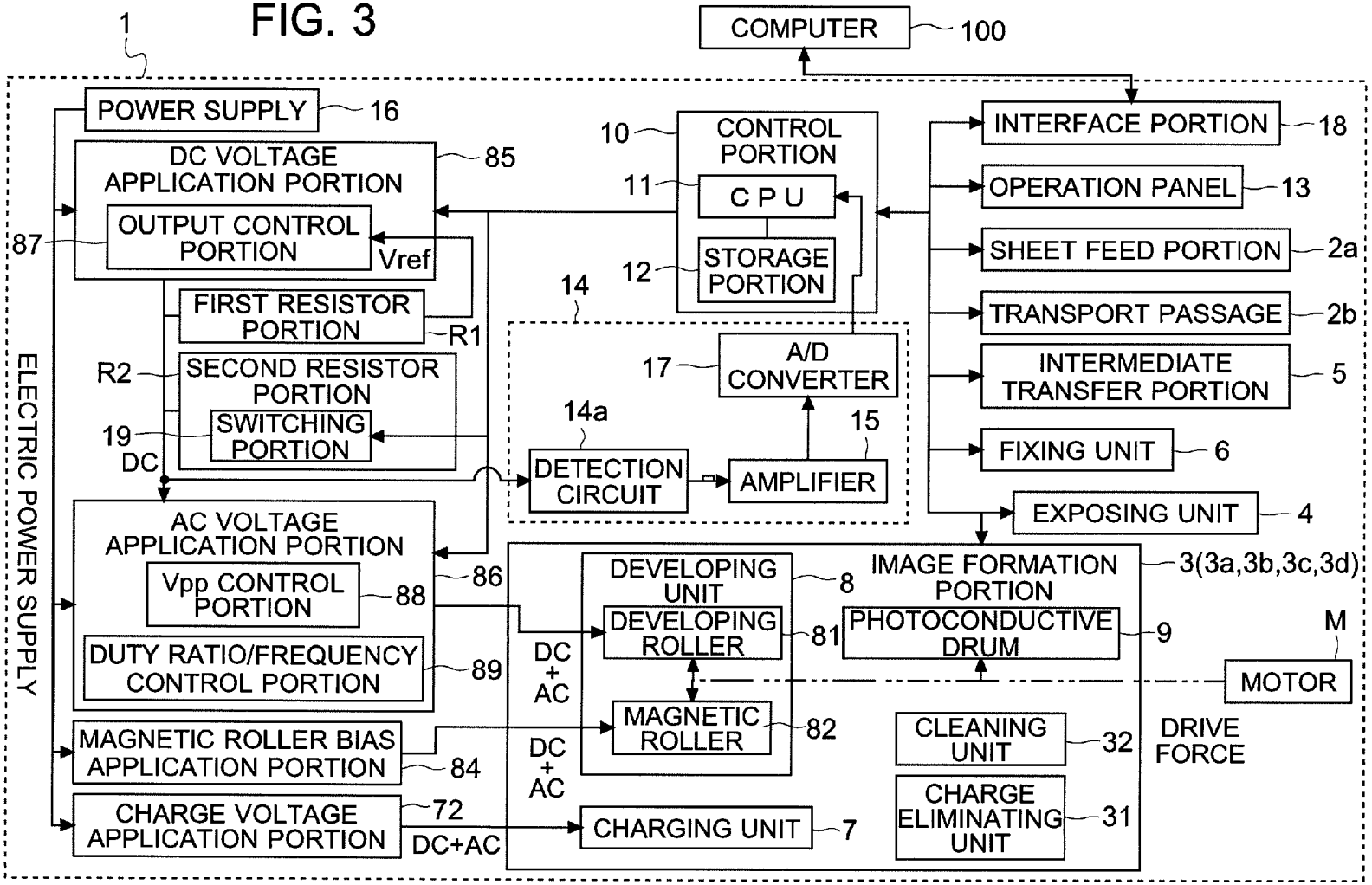
FIG. 3 is a block diagram showing an example of a hardware configuration of the printer according to the embodiment.

Next, with reference to FIG. 3, the hardware configuration of the printer 1 according to the embodiment of the invention will be described. FIG. 3 is a block diagram showing an example of the hardware configuration of the printer 1 according to the embodiment of the invention.

As shown in FIG. 3, the printer 1 according to the embodiment has a control portion 10 inside it. The control portion 10 controls different parts of the printer 1. The control portion 10 also recognizes occurrence of electric discharge by receiving the output of the detection portion 14 (amplifier 15). For example, the control portion 10 is composed of a CPU 11, a storage portion 12, etc. The CPU 11 is a central processing unit, and engages in computation and in the control of different parts of the CPU 11 based on a control program stored and mapped in the storage portion 12. The storage portion 12 is composed of a combination of nonvolatile and volatile storage devices, such as ROM, RAM, and flash ROM. For example, the storage portion 12 stores control programs, control data, etc. for the printer 1. In this invention, programs for setting the voltage applied to the developing roller 81 and the magnetic roller 82 during printing and electric discharge detection are also stored in the storage portion 12.

The control portion 10 is connected to the sheet feed portion 2*a*, the transport passage 2*b*, the image formation portion 3, the exposing unit 4, the intermediate transfer portion 5, the fixing unit 6, etc. The control portion 10 controls the operation of different parts according to control programs and data in the storage portion 12 so that image formation is performed properly.

The control portion 10 is connected to a motor M (corresponding to a drive source) that supplies a drive force for rotating the photoconductive drums 9, the developing rollers 81, the magnetic rollers 82, etc. in the image formation portions 3. At the time of printing and at the time of electric discharge detection, the control portion 10 drives the motor M to rotate the photoconductive drums 9, etc. just mentioned. By driving the motor M, the control portion 10 can also control the sleeves of the developing rollers 81 and the magnetic rollers 82.

To the control portion 10, via an interface portion 18, a computer 100 (such as a personal computer) is connected that serves as the source from which image data to be printed is transmitted. The control portion 10 subjects the received image data to image processing. The exposing unit 4 receives the image data, and forms an electrostatic latent image on the photoconductive drums 9. The charge voltage application portion 72 is a circuit that applies a voltage for charging to the charging rollers 71.

To the control portion 10, a DC voltage application portion 85 is connected. The DC voltage application portion 85 is a circuit that outputs a DC voltage applied to the developing roller 81. That output is fed to the AC voltage application portion 86. The DC voltage application portion 85 has an output control portion 87. The output control portion 87 receives an instruction from the CPU 11 and a feedback reference voltage Vref, and controls the value of the DC voltage that the DC voltage application portion 85 outputs by adjusting that output or stopping outputting of that voltage.

The DC voltage application portion 85 is a circuit (e.g., DC-DC converter, etc.) that is supplied with DC electric power from a power supply 16 (see FIG. 4) within the printer 1, and whose output voltage is variable under the control of the output control portion 87 according to the instruction from the CPU 11. Thus, the AC voltage applied to the developing roller 81 can be biased.

To the control portion 10, the AC voltage application portion 86 is connected. The AC voltage application portion 86 is a circuit that outputs an AC voltage that has a rectangular (pulsating) waveform and whose average value equals the DC voltage that the DC voltage application portion 85 outputs. The AC voltage application portion 86 is connected to the DC voltage application portion 85. The AC voltage application portion 86 applies to the developing roller 81, a voltage having the output voltage of the DC voltage application portion 86 and an AC voltage superimposed on each other. The AC voltage application portion 86 has a Vpp control portion 88 and a duty ratio/frequency control portion 89. The Vpp control portion 88 controls the peak-to-peak voltage of the AC voltage according to an instruction from the CPU 11. The duty ratio/frequency control portion 89 controls the duty ratio and frequency of the AC voltage according to an instruction from the CPU 11.

For example, the AC voltage application portion 86 is a power supply circuit provided with a plurality of switching devices, and reverses the positive and negative polarities of its output by switching, to output an AC voltage (e.g., DC-AC inverter). The duty ratio/frequency control portion 89 controls, for example, the timing with which the polarity of the output of the AC voltage application portion 86 is switched. Thus, the AC voltage application portion 86 can controls the duty ratio and frequency of the AC voltage. Based on the peak-to-peak voltage and duty ratio of the AC voltage to be applied to the developing roller 81, and according to an instruction from the CPU 11, the Vpp control portion 88 steps up, steps down, or otherwise adapts the DC voltage fed from the power supply 16 (see FIG. 3) to vary the positive- and negative-side peak values of the AC voltage. Any configuration may be adopted for the AC voltage application portion 86, and for varying the peak-to-peak voltage, duty ratio, and frequency of the AC voltage, so long as the peak-to-peak voltage, duty ratio, and frequency can be varied.

The AC voltage application portion 86 is provided with, inside it, for example, a step-up circuit that employs a step-up transformer. Thus, a developing bias having the direct current from the DC voltage application portion 85 and the stepped-up AC voltage superimposed on each other is applied to, for example, the roller shaft 811 of the developing roller 81. In this way, a developing bias is applied to the sleeve 812 as well; as a result, the charged toner carried on the sleeve 812 flies Moreover, in this invention, between the DC voltage application portion 85 and the AC voltage application portion 86, a first resistor portion R1 and a second resistor portion R2 are connected, which will be described in detail later. The first resistor portion R1 generates from the DC voltage applied to the developing roller 81, a feedback reference voltage Vref to the DC voltage application portion 85, in order to check whether or not the output of the DC voltage application portion 85 is normal. The reference voltage Vref thus generated is fed back to the output control portion 87, so that the DC voltage application portion 85 maintains the output value as instructed by the CPU 11.

The second resistor portion R2 is connected between the DC voltage application portion 85 and the AC voltage application portion 86. The second resistor portion R2 has a switching portion 19 with which conducting on and off are switchable. The switching portion 19 can select either a conducting state or a non-conducting state according to a control signal (switching signal) from the control portion 10. The control portion 10 brings the second resistor portion R2 into the conducting state at the time of printing, and in the non-conducting state at the time of electric discharge detection (the details will be given later).

The detection portion 14 is connected between, for example, the AC voltage application portion 86 and the DC voltage application portion 85, and has a detection circuit 14*a*, and the amplifier 15 and, in some cases, an A/D converter 17. Based on a variation in the DC voltage applied to the developing roller 81 due to a current (voltage) flowing on occurrence of electric discharge, the detection circuit 14*a* detects a variation in the voltage applied to the developing roller 81 (an electric discharge detection signal). The detection circuit 14*a* outputs the electric discharge detection signal to the amplifier 15. The amplifier 15 amplifies the electric discharge detection signal from the detection portion 14 to output the result to the CPU 11. Specifically, at the time of electric discharge detection, the CPU 11 feeds any of the AC voltage application portions 86 with an instruction to vary stepwise the peak-to-peak voltage etc. of the AC voltage applied to the developing roller 81, and from the output after the A/D conversion by the detection portion 14 (amplifier 15) (e.g., the conversion by the A/D converter 17; so long as the CPU 11 has an A/D converting capability, there is no need to provide the A/D converter 17), and detects whether or not electric discharge is occurring in the relevant image formation portion 3 and determines the magnitude of electric discharge occurring.

In the printer 1 according to the embodiment, the photoconductive drum 9 used has a photoconductive layer of amorphous silicon that is charged positively. This photoconductive drum 9 has the property that the higher the potential of the developing roller 81 when electric discharge occurs, the less likely a large current flows through the photoconductive drum 9. Accordingly, to avoid damage to the photoconductive drum 9 due to a large current, the duty ratio and frequency are so adjusted that electric discharge occurs with the developing roller 81 at a high potential (the details will be given later). Thus, the discharge current only flows from the developing roller 81 to the photoconductive drum 9. Accordingly, the charge current appears as a variation in the DC voltage applied to the developing roller 81. The detection portion 14 thus has only to check for a variation in the DC voltage to the developing roller 81.

The magnetic roller 82 is arranged opposite the developing roller 81 with a predetermined gap in between (where a magnetic brush is formed). The magnetic roller 82 has the roller shaft 821, to which the magnetic roller bias application portion 84 is connected; the magnetic roller bias application portion 84 applies to the magnetic roller 82, a voltage (magnetic roller bias) having the DC voltage and the AC voltage superimposed on each other is applied to move the toner to the developing roller 81. The magnetic roller bias application portion 84 is also connected to the control portion 10. The control portion 10 turns on and off the magnetic roller bias application portion 84, and controls the output voltage, etc.

Figure 4:
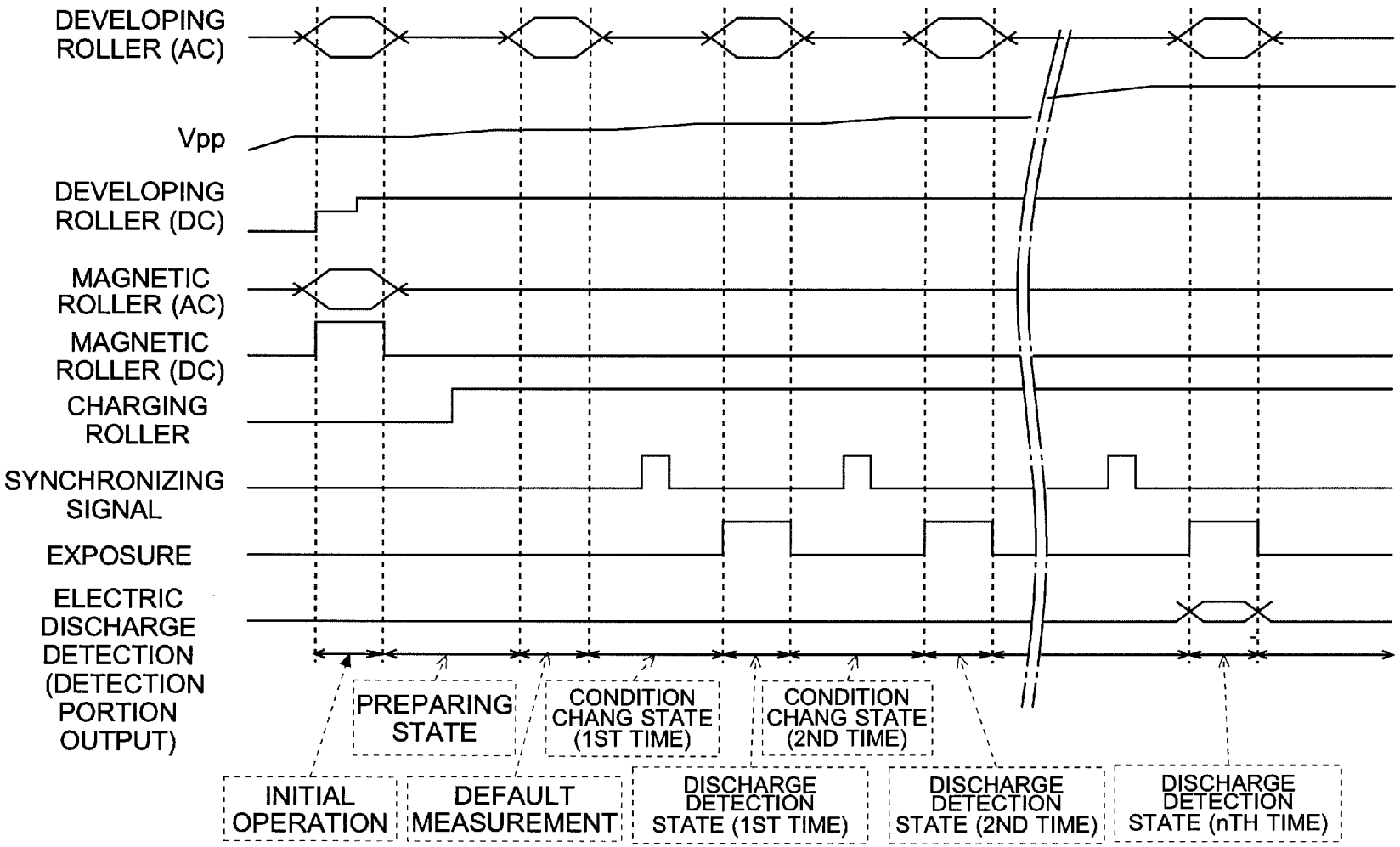
FIG. 4 is a timing chart illustrating an outline of electric discharge detection operation according to the embodiment.
Figure 5:
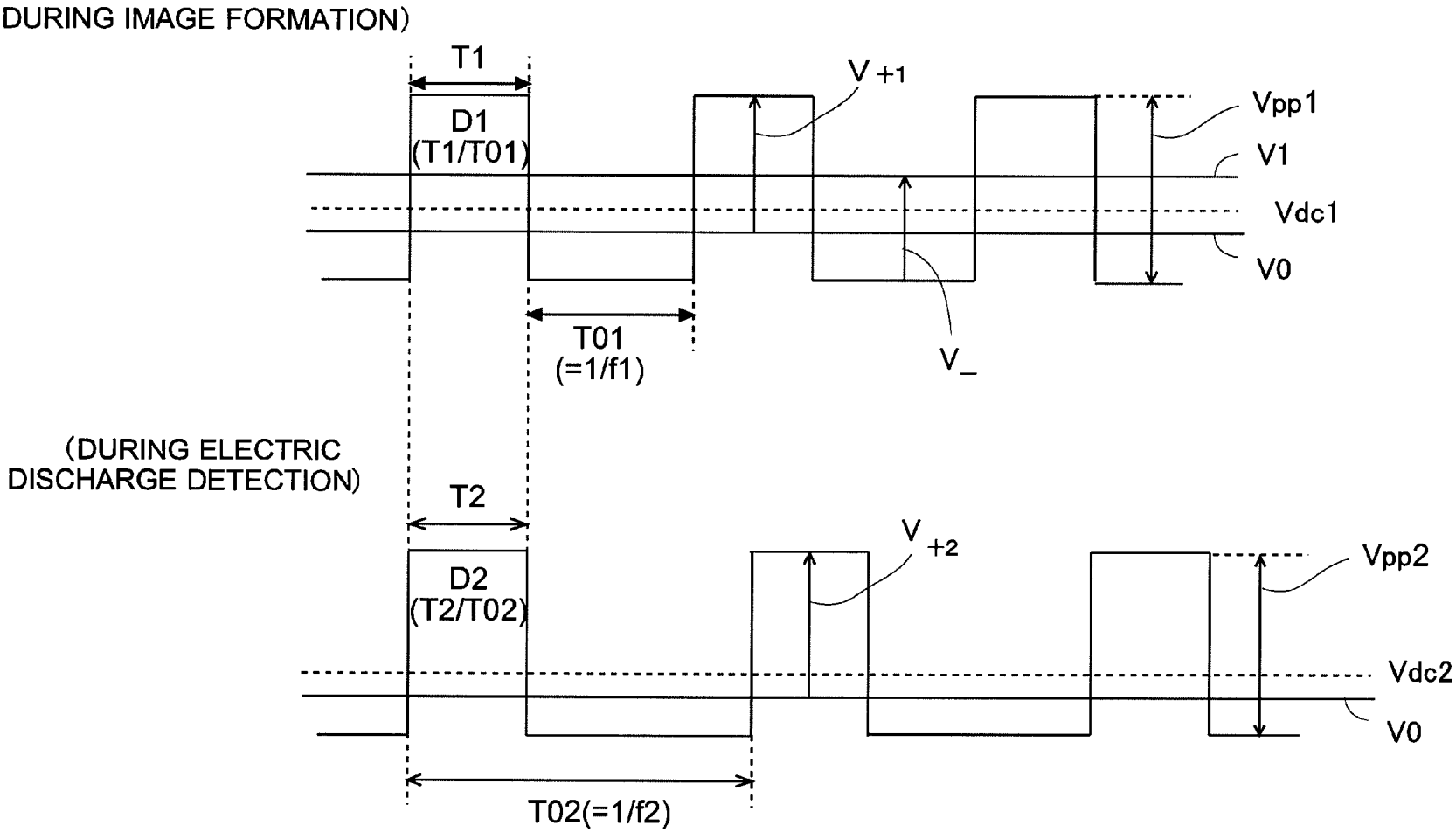
FIG. 5 is a timing chart showing an example of a voltage applied to the developing roller according to the embodiment.

Setting Developing Bias Applied to Developing Roller 81 During Printing and Electric Discharge Detection Next, with reference to timing charts in FIGS. 4 and 5, an example of operation for detecting occurrence of electric discharge between the photoconductive drum 9 and the developing roller 81 will be described. FIG. 4 is a timing chart illustrating an outline of electric discharge detection according to the embodiment of the invention. FIG. 5 is a timing chart showing an example of the voltage applied to the developing roller 81 according to the embodiment of the invention. In this invention, the purpose of detecting electric discharge is to search for the peak-to-peak voltage at which electric discharge starts. This electric discharge is performed for each image formation portion 3, one at a time.

First, with reference to FIG. 4, the outline of electric discharge detection operation will be described. In FIG. 4, "DEVELOPING ROLLER (AC)" indicates the timing with which the AC voltage application portion 86 applies an AC voltage to the developing roller 81. "Vpp" indicates the variation of the magnitude of the peak-to-peak voltage of the AC voltage to the developing roller 81. "DEVELOPING ROLLER (DC)" indicates the timing with which the DC voltage application portion 85 applies a DC voltage to the developing roller 81. "MAGNETIC ROLLER (AC)" indicates the timing with which the magnetic roller bias application portion 84 (see FIG. 3) applies an AC voltage to the magnetic roller 82. "MAGNETIC ROLLER (DC)" indicates the timing with which the magnetic roller bias application portion 84 applies a DC voltage to the magnetic roller 82.

"CHARGING ROLLER" indicates the timing with which the charging unit 7 charges the photoconductive drum 9. "SYNCHRONIZING SIGNAL" indicates the synchronizing signal that the light-receiving element 46 of the exposing unit 4 outputs. "EXPOSURE" indicates the timing with which the photoconductive drum 9 is exposed (irradiated with laser light) in the exposing unit 4. "ELECTRIC DISCHARGE DETECTION (DETECTION PORTION OUTPUT)" indicates the timing with which the detection portion 14 detects electric discharge.

Initial Operation: When electric discharge detection according to the invention is started, first, initial operation is performed. In the initial operation, first, the photoconductive drum 9, the developing roller 81, the intermediate transfer belt 52, etc. start to rotate, and then, in the initial operation, an AC voltage and a DC voltage are applied to the developing roller 81 and the magnetic roller 82 respectively. As a result of this application of the voltage to the magnetic roller 82 in the initial operation, a small amount of toner is fed from the magnetic roller 82 to the developing roller 81. After this initial operation, a transition is made to a preparation state.

Preparation State and Default Measurement: In the preparation state, the charging unit 7 starts to charge the photoconductive drum 9. It should be noted that, until completion of the operation for detecting the peak-to-peak voltage at which electric discharge starts, the voltage applied to the charging unit 7 is kept on. Moreover, the peak-to-peak voltage of the AC voltage applied to the developing roller 81 is raised to the peak-to-peak voltage for default measurement. It should be noted that the peak-to-peak voltage of the AC voltage applied to the developing roller 81 in the default measurement is set at, for example, its minimum settable value. Next, a transition is made to the default measurement, in which the control portion 10 checks whether or not electric discharge is occurring. The default measurement is for checking whether or not electric discharge occurs in a state in which no electric discharge is supposed to occur, and is performed to detect an abnormality in the fitting position of components, such as the detection portion 14, in the circuits, etc. After the default measurement, a transition is made to a condition change state (for the 1st time).

Condition Change State: In the condition change state, the peak-to-peak voltage of the AC voltage applied to the developing roller 81 is varied (e.g., raised) in steps. In the middle of the condition change state, the synchronizing signal, based on which to start the exposure of the exposing unit 4, turns high.

After the synchronizing signal turns high, a transition is made to a discharge detection state (for the 1st time).

Discharge Detection State: In the discharge detection state, a developing bias is applied to the developing roller 81. Moreover, the exposing unit 4 continues exposure (exposure of the entire surface of the photoconductive drum 9; the surface potential of the photoconductive drum 9 is stabilized at about 0V). In the printer 1 according to the embodiment, the charging polarity of both the toner and the photoconductive drum 9 is positive, and accordingly toner attaches to exposed parts; thus continuous exposure is equivalent to formation of an electrostatic latent image of a solid filled image. Accordingly, in the discharge detection state, image data of a solid filled image is fed, for example, from the control portion 10 to the exposing unit 4 (e.g., the storage portion 12 stores image data of a solid filled image).

The discharge detection state lasts for a given length of time (e.g., 0.5 to several seconds). During that period, the photoconductive drum 9 and the developing roller 81 rotate several times. Based on the input from the amplifier 15 to the CPU 11, in a given case, such as when no electric discharge is detected, the control portion 10 effects a transition to the condition change state. In the condition change state, the control portion 10 again instructs the AC voltage application portion 86 to issue an instruction to change the peak-to-peak of the AC voltage. As a result, in the next and any following discharge detection states, whether or not electric discharge is occurring is checked basically with a higher-than-last-time peak-to-peak voltage in the AC voltage applied to the developing roller 81. In other words, until the AC voltage at which electric discharge occurs is identified, the condition change state and the discharge detection state are repeated. During the repetition, the peak-to-peak voltage of the AC voltage applied to the developing roller 81 increases in given step widths. FIG. 4 shows a case where electric discharge is detected in the n-th time discharge detection state.

Next, first, with reference to FIG. 5, the application of the voltage to the developing roller 81 in the discharge detection state will be described. FIG. 5 shows, in its upper part, a timing chart at the time of printing and, in its lower part, a timing chart at the time of electric discharge detection.

First, the rectangular wave in the timing chart at the time of image formation is an example of the waveform of the developing bias (AC+DC) applied to the developing roller 81. "Vdc1" indicates the potential of the bias of the DC voltage application portion 85. "V0" indicates the potential (approximately 0 V, which is the light potential) of the photoconductive drum 9 after exposure by the exposing unit 4. "V1" indicates the potential of the photoconductive drum 9 after charging (the potential of the parts that are not exposed; e.g., about 200 to 300 V). "$V_{+1}$" indicates the potential difference between V0 and the positive peak value of the development bias at the time of printing. "V_" indicates the potential difference between V1 and the negative peak value of the development bias. "Vpp1" indicates the peak-to-peak voltage of the AC voltage applied to the developing roller 81 at the time of printing. "T1" indicates the period in which the rectangular wave is high (positive). "T01" indicates the cycle of the rectangular wave.

On the other hand, the rectangular wave in the timing chart at the time of electric discharge detection represents the waveform of the developing bias applied to the developing roller 81. "Vdc2" indicates the potential of the bias of the DC voltage application portion 85 at the time of detection. "V0" indicates, as in the upper part of FIG. 5, the potential (approximately 0 V) of the photoconductive drum 9 after exposure by the exposing unit 4. "$V_{+2}$" indicates the potential difference between the positive peak value of the developing bias at the time of detection and V0. "Vpp2" indicates the peak-to-peak voltage of the AC voltage applied to the developing roller 81 at the time of detection. "T2" indicates the period in which the rectangular wave is high (positive). "T02" indicates the cycle of the rectangular wave.

First, at the time of electric discharge detection, under an instruction from the control portion 10, the output control portion 87 sets the output of the DC voltage application portion 85 at the set value Vdc2 for electric discharge detection (e.g., 100 V to 200 V). Moreover, under an instruction from the control portion 10, the Vpp control portion 88 sets the AC voltage Vpp2 that the AC voltage application portion 86 outputs (it should be noted that Vpp2 changes its value every new condition change state). Moreover, under an instruction from the control portion 10, the duty ratio/frequency control portion 89 sets, at a set value for electric discharge detection, the duty ratio D2 (the ratio of the high period T2 to the cycle T02, i.e., T2/T02) of the AC voltage that the AC voltage application portion 86 outputs. Moreover, the duty ratio/frequency control portion 89 sets, at a set value for electric discharge detection, the frequency f2 (=1/T02) of the AC voltage that the AC voltage application portion 86 outputs (the lower part of FIG. 5).

Here, the duty ratio D2 is set lower than the duty ratio D1 at the time of printing (the ratio of the high period T1 to the cycle T01, i.e., T1/T01) (e.g., D1=40% and D2=30%). The photoconductive drum 9 according to the embodiment has the property (a diode-like property) that a large current flows through it if electric discharge occurs when the potential of the developing roller 81 is low (at the negative peak); accordingly, the duty ratio D2 is so set that the negative peak voltage has as small an absolute value as possible. This allows electric discharge to occur between the developing roller 81 and the photoconductive drum 9 with the potential of the developing roller 81 higher than that of the photoconductive drum 9. The frequency f2 is so set that the period in which the AC voltage is positive is equal between at the time of printing and at the time of electric discharge detection (i.e., T1=T2; e.g., when D1=40% and D2=30%, and in addition f1=4 kHz, then f2=3 kHz). Thus, for the same period as at the time of printing, the positive voltage is applied to the developing roller 81.

Flow of Control for Electric Discharge Detection Operation

Figure 6:
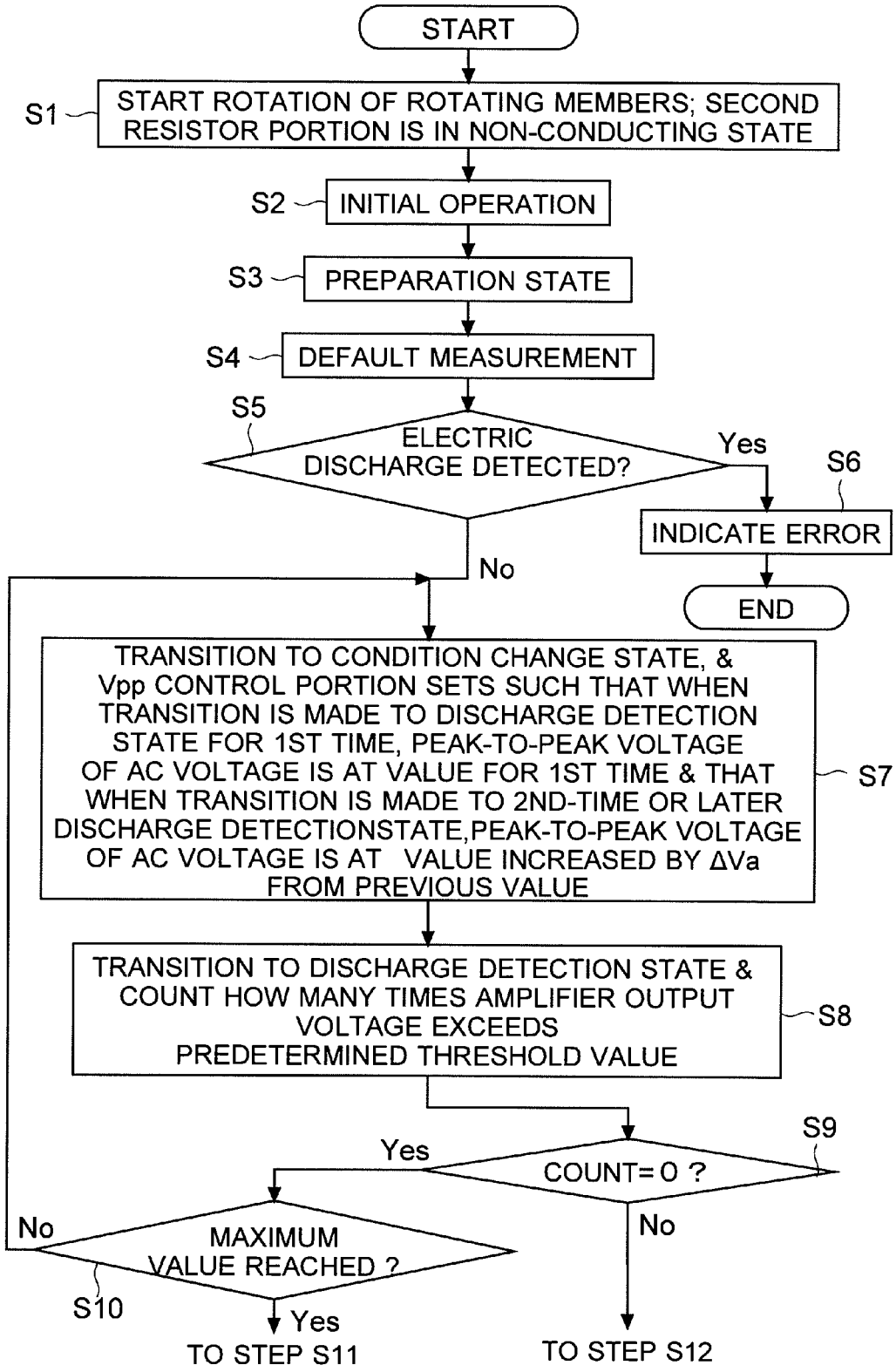
FIG. 6 is a flow chart showing an example of the flow of control for electric discharge detection operation in the printer according to the embodiment.
Figure 7:
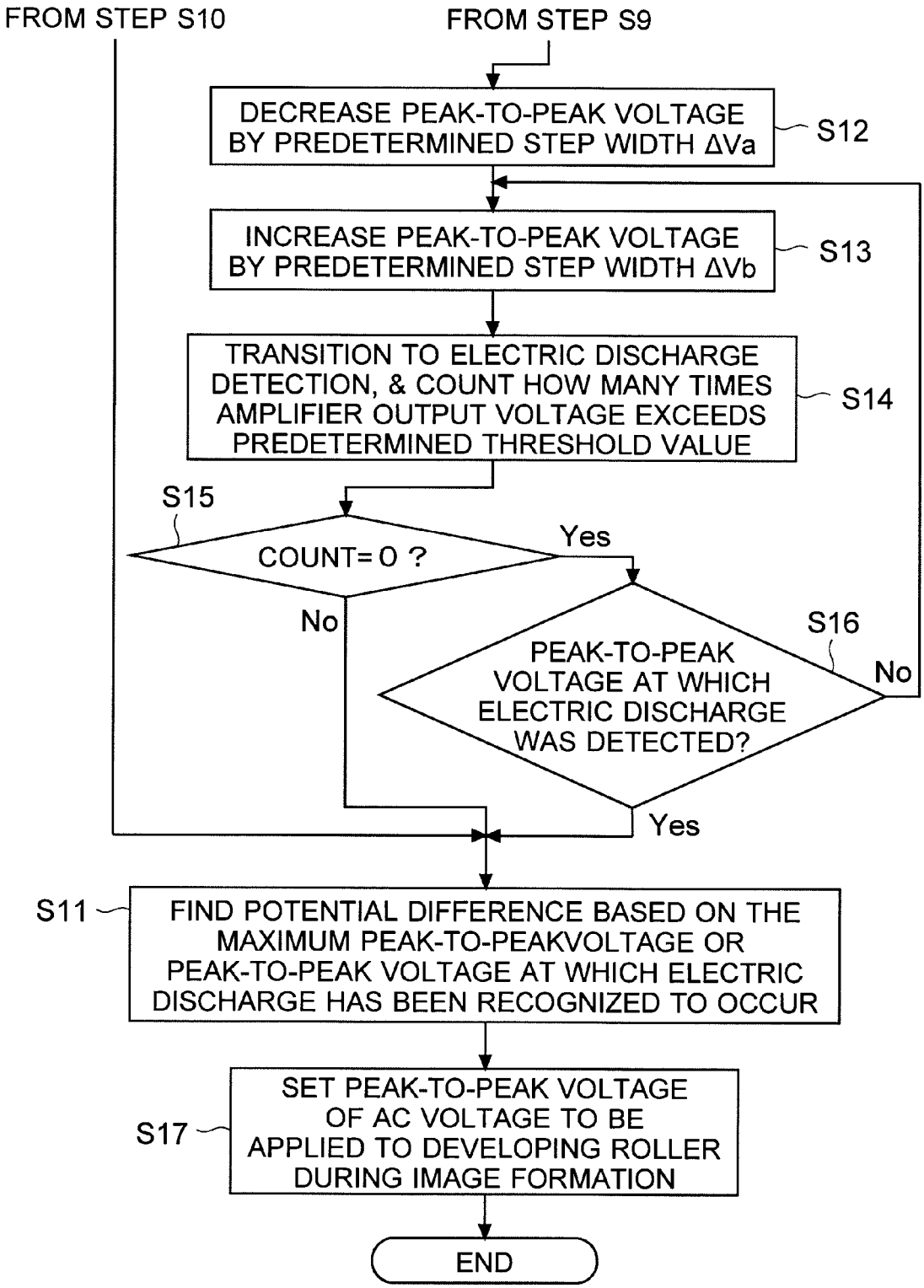
FIG. 7 is a flow chart showing an example of the flow of control for electric discharge detection operation according to the embodiment.

Next, with reference to FIGS. 6 and 7, an example of the flow of a control sequence for intentionally causing electric discharge and detecting it with a view to grasping the peak-to-peak voltage at which electric discharge starts. FIGS. 6 and 7 are flow charts showing an example of the flow of control for electric discharge detection operation in the printer 1 according to the embodiment of the invention. FIGS. 6 and 7 show, in a form divided into two charts, the control sequence related to electric discharge detection according to the embodiment of the invention. These flow charts show the control for one image formation portion 3, and it is repeated four times when performed for all the colors.

This electric discharge detection can be performed, for example, at the time of manufacture for detection of initial defects or for initial setting, at the time of installation of the printer 1, or a the time of replacement of the development unit 8 or the photoconductive drum 9. The reason it is performed at the time of installation is that the atmospheric pressure varies with the altitude of the installation environment (e.g., between a lowland area in Japan and a plateau area in Mexico) and this produces a difference in the voltage at which electric discharge occurs. The reason it is performed at the time of replacement of the developing unit 8 etc. is that the gap between the photoconductive drum 9 and the developing roller 81 changes before and after replacement. The examples just mentioned are not meant as any limitation: electric discharge detection may be performed every time the printer 1 has printed a given number of sheets; the timing with which it is performed may be set as desired.

First, when electric discharge detection operation is started by performing a predetermined operation on the operation panel 13 or the like ("START"), under instructions from the control portion 10 (CPU 11), the motor M and other drive mechanisms set in rotation the various rotating members in the image formation portion 3 and the intermediate transfer portion 5, such as the photoconductive drum 9, the developing roller 81, the magnetic roller 82, and the intermediate transfer belt 52, and the second resistor portion R2 is brought into the non-conducting state (step S1). This driving of the rotating members continues until completion of the operation for detecting the peak-to-peak voltage at which electric discharge starts. Next, the initial operation described with reference to FIG. 4 is performed (step S2).

In particular, according to the invention, the magnetic roller bias is applied to all the magnetic rollers 82 (step S2). Next, a transition is made to the preparation state described with reference to FIG. 4 (step S3), where, for example under an instruction from the CPU 11, the charge voltage application portion 72 starts to apply a voltage to the charging unit 7.

Next, the default measurement described with reference to FIG. 4 is performed (step S4). At this time, whether or not electric discharge occurs is checked (step S5). This default measurement is performed in a state in which no electric discharge is supposed to occur; if occurrence of electric discharge is detected in the default measurement ("Yes" at step S5), an abnormality in the gap length or in the detection portion 14 etc. is likely. In that case, an error indication is given on the operation panel 13 or the like (step S6), and electric discharge detection comes to an end ("END").

On the other hand, if no signal indicating occurrence of electric discharge is fed to the CPU 11 ("No" at step S5), a transition is made to the condition change state described with reference to FIG. 4. Then, under an instruction from the CPU 11, the Vpp control portion 88 makes a setting such that when a transition is made to the discharge detection state for the 1st time, the peak-to-peak voltage of the AC voltage that the AC voltage application portion 86 outputs is at a set value for the 1st time, and that when a transition is made to 2nd time or later discharge detection state, the peak-to-peak voltage of the AC voltage that the AC voltage application portion 86 outputs is increased by a predetermined step width ΔVa (e.g., 30 to 100 V) from its current level (step S7).

After that, a transition is made to the discharge detection state, and the AC voltage application portion 86 and the DC voltage application portion 85 apply the developing bias to the developing roller 81. Specifically, the AC voltage set at step S7 and the like are applied to the developing roller 81, and under an instruction from the CPU 11, exposure is performed. Meanwhile, the CPU 11 counts the number of times that the output voltage of the amplifier 15 becomes higher than a predetermined threshold value (step S8).

Then, whether or not the counted number is 0 is checked (step S9). If it is 0 ("Yes" at step S9), it is recognized that no electric discharge occurs, and the CPU 11 checks whether or not the current peak-to-peak voltage has reached the maximum settable value (e.g., 1,500 to 3,000 V) (step S10). If it has ("Yes" at step S10), a transition is made to step S11 (the details will be given later); otherwise ("No" at step S10), a transition is made to step S7.

If, at step S9, the counted number is 1 or more ("No" at step S9), it is recognized that electric discharge occurs, and the control portion 10 (CPU 11) feeds an instruction to the Vpp control portion 88. According to the instruction, the Vpp control portion 88 makes a setting such that the peak-to-peak voltage of the AC voltage applied to the developing roller 81 is decreased by the predetermined step width ΔVa from that of the previously applied AC voltage (step S12). Subsequently, the Vpp control portion 88 sets the peak-to-peak voltage of the AC voltage applied to the developing roller 81 at a value increased by a predetermined step width ΔVb (step S13). Here, the predetermined step width ΔVb may be a fraction of the predetermined step width ΔVa (like, e.g., when ΔVa=50 V, ΔVb=10 V; when ΔVa=100 V, ΔVb=20 V). In other words, to more finely detect the peak-to-peak voltage at which electric discharge occurs, a return one step is made and the step width of stepwise varying of the peak-to-peak voltage in electric discharge detection is decreased.

There follows, as step S8, the discharge detection state, where the CPU 11 counts the number of times that the output voltage of the amplifier 15 becomes higher than a predetermined threshold value (step S14). In other words, while the peak-to-peak voltage is varied stepwise in step widths of ΔVa, when electric discharge is detected, to more finely ascertain the peak-to-peak voltage at which electric discharge occurs, the discharge detection state and the condition change state are repeated in step widths of ΔVb until electric discharge is detected.

Next, whether or not the counted number is 0 is checked (step S15). If it is 0 ("Yes" at step S15), the control portion 10 recognizes that no electric discharge occurs, and checks whether or not the current peak-to-peak voltage has reached the peak-to-peak voltage at which electric discharge was previously detected (step S16). If it has ("Yes" at step S16), a transition is made to step S11; otherwise ("No" at step S16), a return is made to step S13. By contrast, if the counted value is 1 or more ("No" at step S15), the CPU 11 recognizes that electric discharge occurs at the current peak-to-peak voltage, and an advance is made to step S11.

Next, step S11 will be described in detail. When electric discharge is detected ("No" at step S15, or "Yes" at step S16), or when no electric discharge is detected a the maximum settable peak-to-peak voltage ("Yes" at step S10), the control portion 10 (CPU 11) finds the potential difference $V_{+2}$ shown in FIG. 5 (the potential difference between the photoconductive drum 9 and the developing roller 81 on detection of electric discharge or on application of Vpp2 at its maximum settable value) based on the maximum peak-to-peak voltage or the peak-to-peak voltage Vpp2 at which electric discharge has been recognized to occur, the frequency f2, the duty ratio D2, and the bias setting value Vdc2 (step S11).

$V_{+2}$ can be found easily. The CPU 11 specifies the magnitude of the peak-to-peak voltage and feeds an instruction to the Vpp control portion 88. Accordingly, when the control portion 10 detects electric discharge, it grasps Vpp2 at that time. Then, so that the positive- and negative-side areas may be equal with respect to the duty ratio D2 and Vdc2 as set values, the potential difference between the positive-side peak value of Vpp2 and Vdc2 is found. By adding to this potential difference the potential difference between Vdc2 and V0 (since V0 approximately equals 0 V, the latter potential difference can be regarded as Vdc2), $V_{+2}$ can be found.

Specifically, at the time of electric discharge detection, Vpp2 is varied in steps. Assuming that the duty ratio D2 and the bias setting value Vdc2 are constant, for each different magnitude of Vpp2, $V_{+2}$ can be calculated in advance. Values of $V_{+2}$ calculated for different magnitudes of Vpp2 are taken as data in the form of a look-up table. This table may be stored, for example, in the storage portion 12. The CPU 11 may find $V_{+2}$ by referring to the table.

Next, based on the $V_{+2}$ found, the CPU 11 sets the peak-to-peak voltage Vpp1 of the AC voltage applied to the developing roller 81 at the time of printing such that $V_{+1}$ and $V_{-}$ shown in FIG. 5 are both smaller than the $V_{+2}$ found (step S17). Specifically, Vpp1 may be decided by one of many various methods, and can be found, for example, by calculation. Moreover, consideration needs to be given to circumstances such as the fact that the level by which to make $V_{+1}$ and $V_{-}$ smaller than $V_{+2}$ (how large a margin to secure) in order to eliminate electric discharge varies according to the toner used, etc. Accordingly, through experiments at the time of product development, for example, for each $V_{+2}$ found, the value of Vpp1 at which no electric discharge is recognized to occur at the time of printing is put in a table. The control portion 10 (CPU 11) may then determine Vpp1 by referring to that table. This table may also be stored in the storage portion 12. This makes it possible to apply, at the time of printing, as high an alternating current as possible that does not cause electric discharge. On completion of the setting of this Vpp1, electric discharge detection and the setting of Vpp1 at the time of printing come to an end (END).

Configuration for Applying Developing Bias and Magnetic Roller Bias

Figure 8:
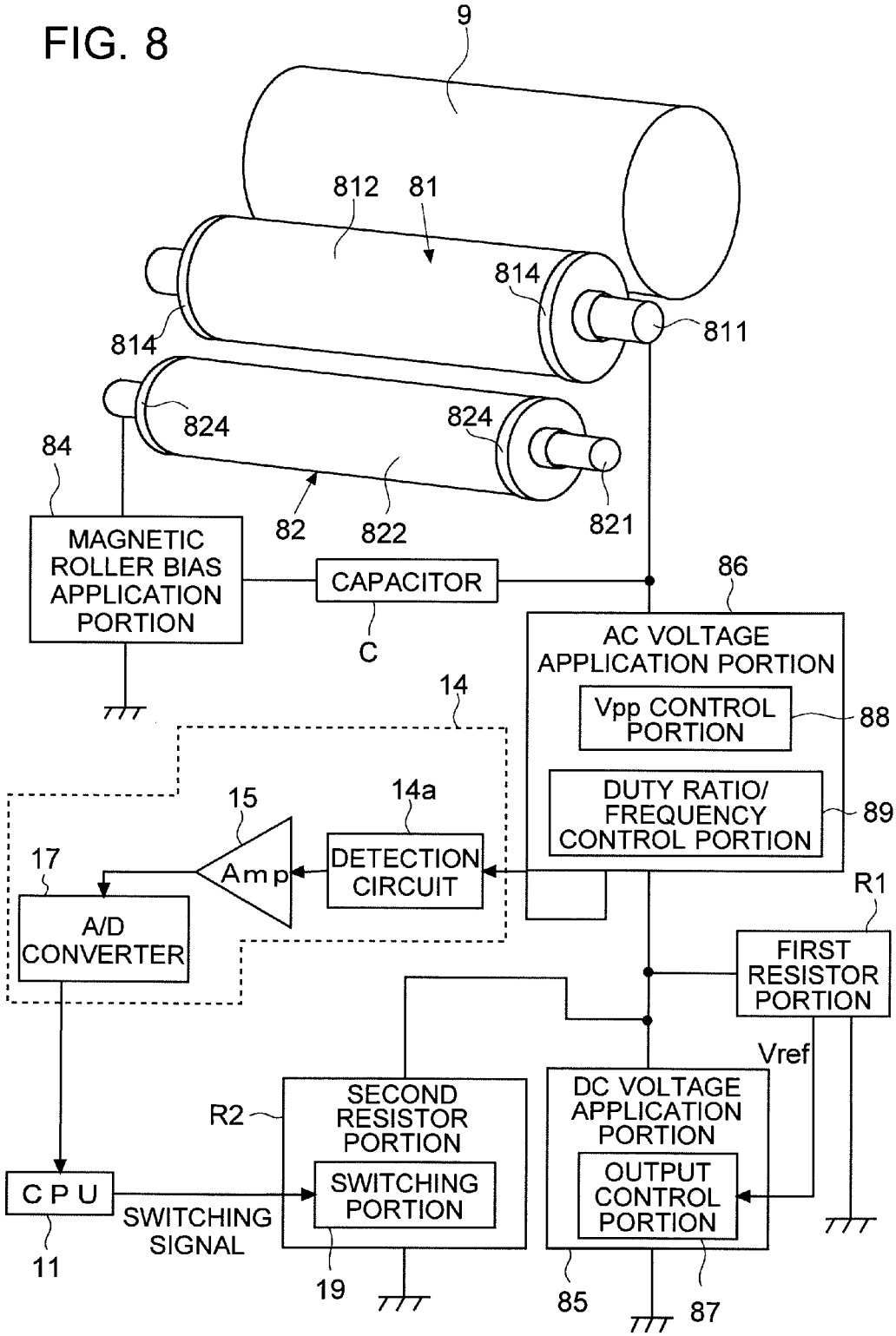
FIG. 8 is a diagram illustrating an example of a configuration for developing bias and magnetic roller bias application according to the embodiment.
Figure 9:
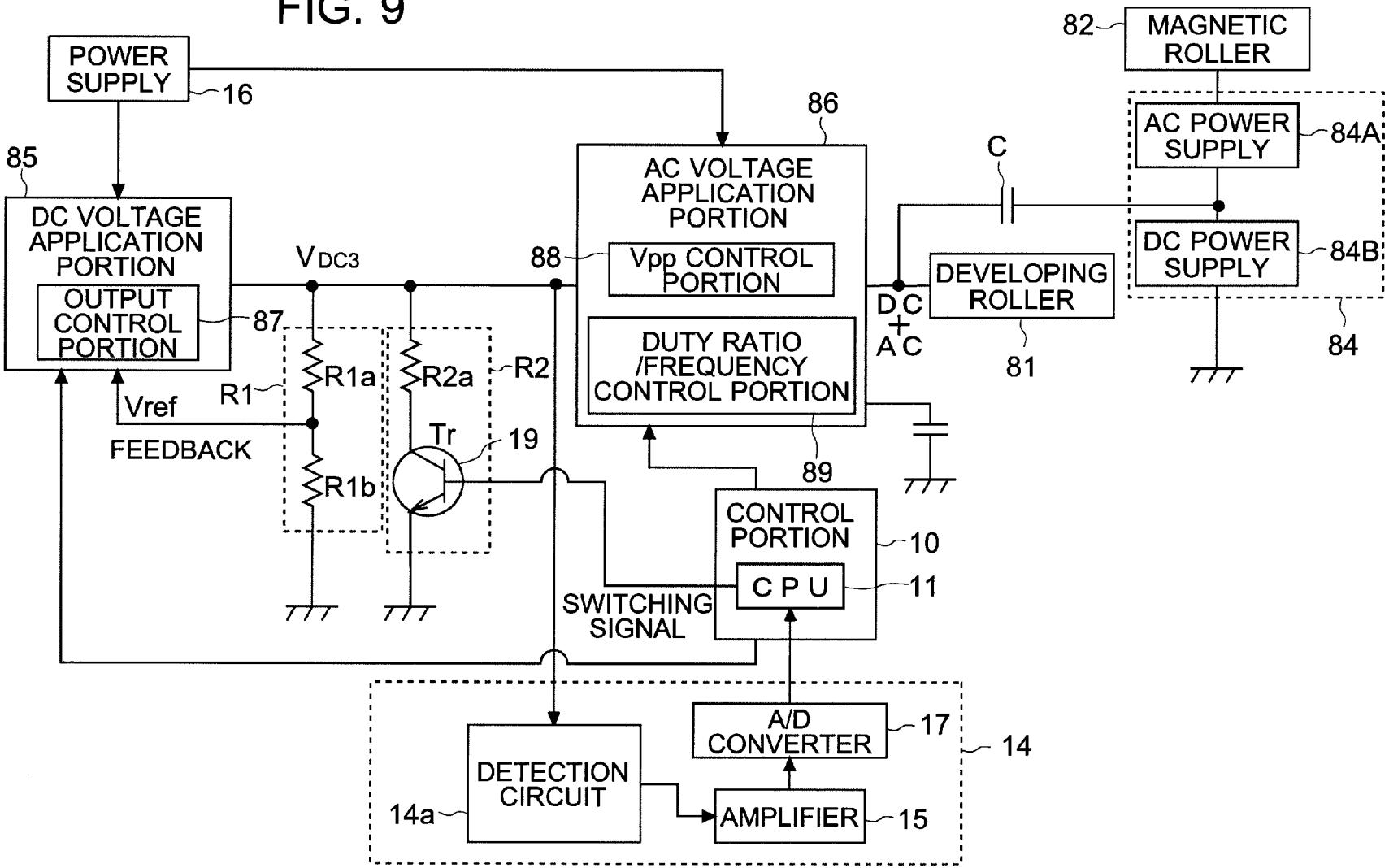
FIG. 9 is a diagram illustrating an example specifically showing a configuration for developing bias and magnetic roller bias application according to the embodiment.

Next, with reference to FIGS. 8 and 9, the configuration for applying a developing bias and a magnetic roller bias according to the embodiment will be described. FIG. 8 is a diagram illustrating an example specifically showing the configuration for applying a developing bias and a magnetic roller bias according to the embodiment. FIG. 9 is a diagram illustrating an example specifically showing the configuration for applying a developing bias and a magnetic roller bias according to the embodiment.

It should be noted that FIGS. 8 and 9 show the configuration only with respect to one image formation portion 3. In other words, the DC voltage application portion 85, the AC voltage application portion 86, the detection portion 14 composed of the detection circuit 14*a* and the amplifier 15, the first resistor portion R1, and the second resistor portion R2 are provided for each image formation portion 3. At the time of electric discharge detection, outputs of the detection portions 14 (amplifiers 15) are switched from one to another sequentially to be fed to the CPU 11, and electric discharge detection is performed for each image formation portion 3. The DC voltage application portion 85, the AC voltage application portion 86, the detection portion 14, and the amplifier 15 may be identified by reference signs having one of the letters a, b, c, and d added to each of them to distinguish among the different image formation portions 3. However, these are each provided with components similar among them, for the sake of simplicity, the following description will dispense with the letters a, b, c, and d.

As shown in FIG. 8, the developing roller 81, which is located opposite the photoconductive drum 9 with a gap in between, has a roller shaft 811, caps 814, and a sleeve 81 carrying toner. The roller shaft 811 has the sleeve 812 put around it. The caps 814, which are circular, are fit into both ends of the sleeve 812. To the roller shaft 811 of the developing roller 81, the DC voltage application portion 85 and the AC voltage application portion 86 are connected for the feeding of toner to the photoconductive drum 9.

Between the amplifier 15 and the control portion 10, an A/D converter 17 is disposed. The A/D converter 17 is a circuit that performs digital conversion on an analog output of the amplifier 15 and that outputs the result to the CPU 11. Since, in the printer 1 according to the embodiment, electric discharge detection is performed for each image formation portion 3, there needs to be only one A/D converter 17.

As shown in FIG. 8, between the DC voltage application portion 85 and the AC voltage application portion 86, there are connected the first resistor portion R1 that generates a feedback reference voltage Vref to the DC voltage application portion 85 and the second resistor portion R2 in which either the conducting state or the non-conducting state is selectable by using the control signal (switching signal) from the control portion 10 (CPU 11) and the switching portion 19.

Next, the configuration for applying a voltage to the magnetic roller 82 will be described. As shown in FIG. 8, the magnetic roller 82 is arranged opposite the developing roller 81 with a predetermined gap in between (where a magnetic brush is formed) and with their axial directions aligned parallel to each other. The magnetic roller 82 has a roller shaft 821, a sleeve 822 that carries toner and a carrier, and caps 824. The roller shaft 821 has the sleeve 822 put around it, and the caps 824, which are circular, fit into both ends of the sleeve 822. To the roller shaft 821, the magnetic roller bias application portion 84 is connected that applies a magnetic roller bias to the magnetic roller 82. The magnetic roller bias application portion 84 applies a magnetic roller bias to the magnetic roller 82; as a result, charged toner moves to the developing roller 81 by an electrostatic force.

Moreover, the output of the AC voltage application portion 86 is connected to the roller shaft 811 of the developing roller 81, and branches into the magnetic roller bias application portion 84 via a capacitor C for coupling. With this connection, a voltage having the voltage outputted from the magnetic roller bias application portion 84 on the AC voltage outputted from the AC voltage application portion 86 is applied to the magnetic roller 82.

Next, with reference to FIG. 9, the configuration for applying a developing bias and a magnetic roller bias will be described in more detail. First, as described above, the DC voltage application portion 85 may adopt, for example, a DC-DC converter. The DC voltage application portion 85 steps up or otherwise adapts the DC voltage fed from the power supply 16, to output the resulting DC voltage.

As described above, the AC voltage application portion 86 may adopt, for example, a DC-AC inverter. The AC voltage application portion 86 superimposes an AC voltage on the output voltage of the DC voltage application portion 85 that is obtained by stepping up or otherwise adapting the DC voltage fed from the power supply 16, to output the result. In other words, the AC voltage outputted from the AC voltage application portion 86 is biased by the DC voltage outputted from the DC voltage application portion 85.

For example, between the DC voltage application portion 85 and the AC voltage application portion 86, the first resistor portion R1 is connected. The first resistor portion R1 is composed of, for example, two resistors, namely a resistor R1*a* and a resistor R1*b* connected in series. The first resistor portion R1 has one end thereof connected to a lead wire between the DC voltage application portion 85 and the AC voltage application portion 86, and has the other end thereof connected to a ground. The output control portion 87 of the DC voltage application portion 85 is fed with a voltage between the resistor R1*a* and the resistor R1*b* as the feedback reference voltage Vref. In other words, a voltage generated as a result of division by the resistors R1*a* and R1*b* serves as the reference voltage Vref.

Moreover, for example, between the DC voltage application portion 85 and the AC voltage application portion 86, the second resistor portion R2 is connected. The second resistor portion R2 is composed of, for example, a resistor R2*a* and a transistor Tr (corresponding to the switching portion 19). The resistor R2*a* is, at one end thereof, connected to a collector of the transistor Tr; the resistor R2*a* is, at the other end thereof, connected to a lead wire between the DC voltage application portion 85 and the AC voltage application portion 86. A base of the transistor Tr and one of the ports of the CPU 11 inside the control portion 10 are connected to each other. The CPU 11 can switch the second resistor portion R2 between the conducting state and the non-conducting state by switching the voltage of that port between high and low.

In the printer 1 according to the embodiment, the developing bias outputted from the AC voltage application portion 86 is fed to the magnetic roller bias application portion 84 via the capacitor C. That is, the magnetic roller bias application portion 84 receives the output of the AC voltage application portion 86 via the capacitor C. The magnetic roller bias voltage application portion 84, which applies to the magnetic roller 82, for example a voltage having the AC voltage and the DC voltage superimposed on each other, has an AC power supply 84A and a DC power supply 84B, separated from the developing roller 81. For example, as a result of passing through the capacitor C, the developing bias becomes an AC voltage having its DC component eliminated therefrom, namely has a waveform of an AC voltage generated by the AC voltage application portion 86, and thereafter, is fed between the AC power supply 84A and the DC power supply 84B.

In this embodiment, the toner is charged positively, and an electrostatic force is used for moving that toner. Accordingly, at the time of printing, etc., to move the toner from the magnetic roller 82 to the developing roller 81, for example the output voltage value (e.g., 300 to 500 V) of the DC power supply 84B inside the magnetic bias application portion 84 is made larger than the DC voltage value (e.g., 50 to 200 V) of the developing bias. This setting of each DC voltage value can form a state in which the magnetic roller 82 is at a higher potential. This facilitates moving of the toner toward the developing roller 81. The output voltage of the AC power supply 84A inside the magnetic roller bias application portion 84 is made to have, for example, the same frequency, but opposite in phase, as compared with the output of the AC voltage application portion 86. Moreover, the output voltage of the AC power supply 84A is made to have its peak-to-peak voltage and its duty ratio larger than the output AC voltage of the AC voltage application portion 86.

With this configuration, based on the AC voltage in the developing bias, the magnetic roller bias is applied to the magnetic roller 82. That is, the magnetic roller 82 receives application of the voltage having the output of the AC voltage application portion 86 via the capacitor C and the output of the magnetic roller bias application portion 84 superimposed on each other. Accordingly, the potential difference between the developing roller 81 and the magnetic roller 82 varies in line with the waveform of the AC voltage of the magnetic roller bias application portion 84. Thus, it is possible to control the amount of toner fed from the magnetic roller 82 to the developing roller 81, etc. by using the peak-to-peak voltage or the duty ratio of the AC voltage that the magnetic roller bias portion 84 applies. On the other hand, to control the amount of toner fed from the developing roller 81 to the photoconductive drum 9, it is only necessary to adjust the output voltages of the DC voltage application portion 85 and of the AC voltage application portion 86. That is, it is possible to adjust the developing bias and the magnetic roller bias separately from each other, and hence to facilitate balance and control of the amount of toner to be fed.

Problems Arising from Developing Roller 81 Varying its Potential Due to External Factors Next, with reference to FIG. 9, problems caused by a variation in the potential of the developing roller 81 due to external factors and solutions to them will be described. First, at the time of printing, the potential of the developing roller 81 may rise (float) unexpectedly. For example, the developing roller 81 rotates during printing; a friction induced by that rotation may cause a rise in the potential of the toner carried on the developing roller 81, etc (in a state in which the toner, etc. is present between the developing roller 81 and the magnetic roller 82, and in which the developing roller 81 is in contact with the toner), leading to a rise in the potential of the developing roller 81 (friction-charging).

Moreover, to properly feed the toner from the magnetic roller 82 to the developing roller 81, during printing or the like, the control portion 10 may feed to the magnetic roller bias application portion 84, an instruction to vary (e.g., to step up) the output value of the DC power supply 84B. Accordingly, the output voltage of the DC power supply 84B inside the magnetic roller bias application portion 84 may be varied. In that case, although the capacitor C is present between the AC voltage application portion 86 and the magnetic roller bias application portion 84, the developing roller 81 may experience a rise or any other change in the potential due to a transient event. Moreover, that change may be steep and abrupt.

As the potential of the developing roller 81 increases or otherwise varies, as described above, due to external factors, such as friction-charging and connection between the magnetic roller bias application portion 84 and the developing roller 81 (connection via the capacitor C), the potential (represented by $V_{DC3}$ in FIG. 9) between the AC voltage application portion 86 and the DC voltage application portion 85 also increases. (It should be noted that the AC voltage application portion 86 simply superimposes an AC voltage on the output of the DC voltage application portion 85).

Moreover, as the potential between the DC voltage application portion 85 and the AC voltage application portion 86 increases, the potential of the feedback reference voltage Vref generated by the first resistor portion R1 also increases. Regardless of the fact that the external factor has caused the potential of the developing roller 81 to rise, when the variation in its potential is abrupt or for other reasons, the DC voltage application portion 85 may recognize that its output voltage has increased too far. As a result, the output control portion 87 may greatly decrease the output voltage value of the DC voltage application portion 85 or may stop the DC voltage application portion 85. The DC-DC converter and the like, once stopped, need a given time before returning to the previous output voltage values. If the DC voltage application portion 85 is stopped during printing in this way, an abnormality occurs in the density in the toner images to be formed, causing degradation of the image quality.

Thus, in the printer 1 according to the embodiment, for example between the DC voltage application portion 85 and the AC voltage application portion 86, there is provided the second resistor portion R2 (a portion enclosed by a broken line in FIG. 9) that is brought into the conducting state at the time of printing. As shown in FIG. 9, conducting is controlled by the transistor Tr. At the time of printing, the transistor Tr is brought into the conducting state; thus, even when the potential between the DC voltage application portion 85 and the AC voltage application portion 86 is likely to rise due to an external factor, a resistance value obtained by combining the first and the second resistor portions R1 and R2 decreases. Accordingly, with the second resistor portion R2 in the conducting state, a current tends to flow, making electric charge escape to the ground quickly as compared with a case without the second resistor portion R2. As a result, an abrupt change in the potential between the DC voltage application portion 85 and the AC voltage application portion 86 becomes unlikely to appear. Thus, at the time of printing, the control portion 10 in the printer 1 according to the embodiment controls the switching portion 19 to bring the transistor Tr into an on state and the second resistor portion R2 into the conducting state; this makes it possible to prevent an abrupt change of the output, stopping of the operation, etc. of the DC voltage application portion 85.

Incidentally, the detection portion 14 for detecting occurrence of electric discharge is connected between the DC voltage application portion 85 and the AC voltage application portion 86. As described above, in the printer 1 according to the embodiment, at the time of electric discharge detection, the duty ratio, etc. are controlled such that electric discharge occurs with the developing roller 81 at a high potential (when the potential is high). A discharge current is converted into a voltage by the first resistor portion R1. Thus, occurrence of electric discharge can be grasped as a variation in the DC voltage applied to the developing roller 81. Accordingly, to find that variation in the DC voltage, the detection portion 14 is connected between, for example, the DC voltage application portion 85 and the AC voltage application portion 86. In this way, the printer 1 according to the embodiment detects the electric discharge start voltage (peak-to-peak voltage at which electric discharge starts). That is, electric discharge to be detected is not large but minute, and based on a minute current, occurrence of electric discharge is recognized. When the discharge current is detected, through conversion into a voltage by using a resistor having a high resistance value, electric discharge can be detected to have occurred, with increased sensitivity.

In the printer 1 according to the embodiment, at the time of electric discharge detection in which the AC voltage application portion 86 is made to vary stepwise the peak-to-peak voltage of the AC voltage applied to the developing roller 81, a voltage at which electric discharge occurs between the photoconductive drum 9 and the developing roller 81 is detected, the control portion 10 controls the switching portion 19 to bring the transistor Tr into an off state and the second resistor portion R2 in the non-conducting state. As a result, the resistance value between the AC voltage application portion 86 and the DC voltage application portion 85 increases, and thus, the variation in the DC voltage between the DC voltage application portion 85 and the AC voltage application portion 86 caused by a discharge current also increases; this permits the detection portion 14 to detect electric discharge with increased sensitivity.

Moreover, in the printer 1 according to the embodiment, the resistance value of the first resistor portion R1 (a combined resistance value of the resistor portion R1*a* and the resistor R1*b*) is larger than that of the second resistor portion R2 (e.g., 10 versus 1). Thus, at the time of printing, the voltage between the DC voltage application portion 85 and the AC voltage application portion 86 is unlikely to increase, and at the time of electric discharge detection, sensitivity in detecting electric discharge can be increased.

In this way, the control portion 10 controls the switching portion 19 to bring the second resistor portion R2 into the conducting state at the time of printing and in the non-conducting state at the time of electric discharge detection; thus, during printing, the first and the second resistor portions R1 and R2 are in a relationship in which they are arranged in parallel, and the combined resistor value between the DC voltage application portion 85 and the AC voltage application portion 86 decreases. Accordingly, despite the potential of the developing roller 81 varying due to an external factor, electric charge tends to escape. That is, the voltage value fed back to the DC voltage application portion 85 is no longer greatly increased or otherwise varied; this permits the DC voltage application portion 85 to operate stably. As a result, it is possible to provide an image forming apparatus that helps achieve a stable density in images to be formed, and that thus offers high image quality.

On the other hand, during electric discharge detection, the second resistor portion R2 is put in the non-conducting state, so that the resistance value between the DC voltage application portion 85 and the AC voltage application portion 86 is made large; thus, a variation in the voltage is found easily even for minute electric discharge, and electric discharge can be detected to have occurred, with increased sensitivity. Thus, it is possible to search an electric discharge start voltage with increased accuracy, to enhance development efficiency by applying to the developing roller 81, an AC voltage having a peak-to-peak voltage that causes no electric discharge and that is as high as possible at the time of printing, and to thus provide an image forming apparatus that offers high image quality.

The printer 1 according to the embodiment (image forming apparatus) is provided with the magnetic roller 82 for feeding the toner to the developing roller 81, and the magnetic roller bias application portion 84 that receives application of the output of the AC voltage application portion 86 via the capacitor C, and that applies a voltage to the magnetic roller 82 to move the toner to the developing roller 81. The magnetic roller 82 receives application of a voltage having the output of the AC voltage application portion 86 via the capacitor C and the output of the magnetic roller bias application portion 84 superimposed on each other. In a configuration in which the magnetic roller bias application portion 84 is connected to the output of the AC voltage application portion 86 via the capacitor C, and in which the magnetic roller 82 receives application of the output of the AC voltage application portion 86 and the output of the magnetic roller bias application portion 84 superimposed on each other, a variation in the output of the magnetic roller bias application portion 84 acts as an external factor, which possibly causes a variation in the voltage value that is fed back to the DC voltage application portion 85; as a result, the DC voltage application portion 85 may be stopped or otherwise encounter an unstable condition. With the configuration according to the embodiment, however, even with the magnetic roller bias application portion 84 being connected to the output side of the AC voltage application portion 86, the DC voltage application portion 85 does not operate unstably.

The magnetic roller bias application portion 84 of the printer 1 (image forming apparatus) according to the embodiment includes the AC power supply 84A and the DC power supply 84B. In the printer 1 according to the embodiment, however, during printing, even when the output voltage of the DC voltage 84B is varied, electric charge tends to escape because the second resistor portion R2 is brought in the conducting state. Accordingly, the voltage Vref that is fed back to the DC voltage application portion 85 is no longer greatly increased or otherwise varied; this permits the DC voltage application portion 85 to operate stably.

In the printer 1 (image forming apparatus) according to the embodiment, the first resistor portion R1 has its resistance value larger than the second resistor portion R2. Since the resistance value of the first resistor portion R1 is larger than that of the second resistor portion R2, even when the potential of the developing roller 81 varies due to an external factor, during printing, electric charge tends to escape quickly; this is because the resistance value of the second resistor portion R2 is smaller than that of the first resistor portion R1, and because the second resistor portion R2 is in the conducting state. Thus, it is possible to smoothly accommodate the variation in the potential of the developing roller 81 due to an external factor.

In the printer 1 (image forming apparatus) according to the embodiment, the first resistor portion R1 is a serial circuit having two resistors joining together and connected between the DC voltage application portion 85 and the AC voltage application portion 86, and a voltage between the two resistors is fed to the DC voltage application portion 85 as the feedback voltage Vref. Thus, it is possible to easily make the resistance value of the first resistor portion R1 larger than that of the second resistor portion R2. Moreover, the first resistor portion R1 is formed with a simple and inexpensive configuration.

In the printer 1 (image forming apparatus) according to the embodiment, the switching portion 19 is the transistor Tr. Thus, it is possible to control the conducting and non-conducting states of the second resistor portion R2; moreover, the switching portion 19 is formed with a simple and inexpensive configuration.

With the printer 1 (image forming apparatus) according to the embodiment, when electric discharge is detected to have occurred during electric discharge detection, the control portion 10 finds a potential difference between the photoconductive drum 9 and the developing roller 81 relative to a peak-to peak voltage that was applied to the developing roller 81 when electric discharge occurred, and then determines an AC voltage to be applied to the photoconductive drum 9 during image formation such that a potential difference between surface potentials of the developing roller 81 and the photoconductive drum 9 during image formation is smaller than the potential difference. Thus, based on the correctly grasped potential difference, between the developing roller 81 and the photoconductive drum 9, that causes electric discharge, it is possible to properly set an AC voltage such that development efficiency is enhanced and no electric discharge occurs during image formation.

Next, another embodiment will be described. The embodiment described above deals with an example where, first, primary transfer is performed from the photoconductive drum 9 onto the intermediate transfer belt 52 and, then, secondary transfer is performed onto a sheet. The invention can be applied, however, also in a construction in which toner images are directly transferred from the individual photoconductive drums 9 to a sheet (e.g., a construction in which a transfer roller makes direct contact with each photoconductive drum 9 and a sheet passes through the nip between them, a construction in which a transport belt makes contact with each photoconductive drum 9 and a sheet is placed on a transport belt so that the sheet passes through the nip between them, etc.).

Although the embodiment described above deals with a case where the photoconductive drum 9 and the toner are of a positive-charging type, the invention can be applied also in a case where a photoconductive drum 9 and toner of a negative-charging type are used. Although the embodiment described above deals with a color image forming apparatus, the invention can be applied to a monochrome image forming apparatus having, for example, an image formation portion 3*a* (black) alone.

It should be understood that the embodiments of the invention described above are not meant to limit the scope of the invention in any way and may be implemented with many variations and modifications made within the spirit of the invention.

What is claimed is:

1. An image forming apparatus comprising:

a photoconductive drum;

a developing roller opposite the photoconductive drum with a gap secured in between, and carrying toner that is fed to the photoconductive drum;

a DC voltage application portion outputting, as an output, a DC voltage applied to the developing roller, and receiving a feedback voltage to adjust the output or stop the outputting;

an AC voltage application portion connected to the DC voltage application portion, and applying to the developing roller, a voltage having the DC voltage outputted from the DC voltage application portion and an AC voltage superimposed on each other;

a detection portion detecting occurrence of electric discharge between the developing roller and the photoconductive drum based on a variation in the DC voltage applied to the developing roller;

a first resistor portion generating from the DC voltage applied to the developing roller the feedback voltage that is fed to the DC voltage application portion;

a second resistor portion connected between the DC voltage application portion and the AC voltage application portion, and having a switching portion with which conducting on and off are switchable; and a control portion controlling the apparatus, recognizing whether or not electric discharge has occurred based on an output of the detection portion, and controlling the switching portion, at a time of printing, to bring the second resistor portion into a conducting state, and at a time of electric discharge detection in which while the AC voltage application portion is made to vary stepwise a peak-to-peak voltage of the AC voltage applied to the developing roller, a peak-to-peak voltage at which electric discharge start between the photoconductive drum and the developing roller is detected, to bring the second resistor portion into a non-conducting state.

2. The image forming apparatus according to claim 1, further comprising:

a magnetic roller feeding the toner to the developing roller; and a magnetic roller bias application portion receiving an output of the AC voltage application portion via a capacitor, and applying a voltage to the magnetic roller to move the toner to the developing roller, wherein the magnetic roller receives application of a voltage having the output of the AC voltage application portion via the capacitor and an output of the magnetic roller bias application portion superimposed on each other.

3. The image forming apparatus according to claim 2, wherein the magnetic roller bias application portion includes:

an AC power supply; and a DC power supply.

4. The image forming apparatus according to claim 1, wherein the first resistor portion has a resistance value larger than the second resistor portion.

5. The image forming apparatus according to claim 2, wherein the first resistor portion has a resistance value larger than the second resistor portion.

6. The image forming apparatus according to claim 1, wherein the first resistor portion is a serial circuit having two resistors joining together, and connected between the DC voltage application portion and the AC voltage application portion, and a voltage between the two resistors is fed to the DC voltage application portion as the feedback voltage.

7. The image forming apparatus according to claim 2, wherein the first resistor portion is a serial circuit having two resistors joining together, and connected between the DC voltage application portion and the AC voltage application portion, and a voltage between the two resistors is fed to the DC voltage application portion as the feedback voltage.

8. The image forming apparatus according to claim 1, wherein the switching portion is a transistor.

9. The image forming apparatus according to claim 2, wherein the switching portion is a transistor.

10. The image forming apparatus according to claim 1, wherein when electric discharge is detected to have occurred during the electric discharge detection, the control portion finds a potential difference between the photoconductive drum and the developing roller relative to a peak voltage of the AC voltage that was applied to the developing roller when electric discharge occurred, and determines an AC voltage to be applied to the photoconductive drum during image formation such that a potential difference between surface potentials of the developing roller and the photoconductive drum during image formation is smaller than the potential difference.

11. A method for controlling an image forming apparatus, the image forming apparatus including:

a photoconductive drum;

a developing roller opposite the photoconductive drum with a gap secured in between, and carrying toner that is fed to the photoconductive drum;

a DC voltage application portion outputting, as an output, a DC voltage applied to the developing roller, and receiving a feedback voltage to adjust the output or stop the outputting;

an AC voltage application portion connected to the DC voltage application portion, and applying to the developing roller, a voltage having the DC voltage outputted from the DC voltage application portion and an AC voltage superimposed on each other;

a detection portion detecting occurrence of electric discharge between the developing roller and the photoconductive drum based on a variation in the DC voltage applied to the developing roller;

a first resistor portion generating from the DC voltage applied to the developing roller the feedback voltage that is fed to the DC voltage application portion;

a second resistor portion connected between the DC voltage application portion and the AC voltage application portion, and having a switching portion with which conducting on and off are switchable; and a control portion controlling the apparatus, and recognizing whether or not electric discharge has occurred based on an output of the detection portion, the method comprising:

a step in which the control portion controls the switching portion to bring the second resistor portion into a conducting state during printing; and a step in which the control portion controls the switching portion to bring the second resistor portion into a non-conducting state during electric discharge detection in which while the AC voltage application portion is made to vary stepwise a peak-to-peak voltage of an AC voltage applied to the developing roller, a peak-to-peak voltage at which electric discharge start between the photoconductive drum and the developing roller is detected.

12. The method for controlling the image forming apparatus according to claim 11, the image forming apparatus further including a magnetic roller bias application portion receiving an output of the AC voltage application portion via a capacitor, and applying a voltage to the magnetic roller that feeds toner to the developing roller in order to move the toner to the developing roller, the method further comprising a step in which the magnetic roller bias application portion applies to the magnetic roller, a voltage having the output of the AC voltage application portion via the capacitor and an output of the magnetic roller application portion superimposed on each other.

13. The method for controlling the image forming apparatus according to claim 12, wherein the magnetic roller bias application portion includes:

an AC power supply; and a DC power supply.

14. The method for controlling the image forming apparatus according to claim 11, wherein the first resistor portion has a resistance value larger than the second resistor portion.

15. The method for controlling the image forming apparatus according to claim 12, wherein the first resistor portion has a resistance value larger than the second resistor portion.

16. The method for controlling the image forming apparatus according to claim 11, wherein the first resistor portion is a serial circuit having two resistors joining together, and connected between the DC voltage application portion and the AC voltage application portion, and a voltage between the two resistors is fed to the DC voltage application portion as the feedback voltage.

17. The method for controlling the image forming apparatus according to claim 12, wherein the first resistor portion is a serial circuit having two resistors joining together, and connected between the DC voltage application portion and the AC voltage application portion, and a voltage between the two resistors is fed to the DC voltage application portion as the feedback voltage.

18. The method for controlling the image forming apparatus according to claim 11, wherein the switching portion is a transistor.

19. The method for controlling the image forming apparatus according to claim 12, wherein the switching portion is a transistor.

20. The method for controlling the image forming apparatus according to claim 11, further comprising:

when electric discharge is detected to have occurred during the electric discharge detection, a step in which the control portion finds a potential difference between the photoconductive drum and the developing roller relative to a peak voltage of the AC voltage that was applied to the developing roller when electric discharge occurred, and then determines an AC voltage to be applied to the photoconductive drum during image formation such that a potential difference between surface potentials of the developing roller and the photoconductive drum during image formation is smaller than the potential difference.

* * * * *